United States Patent [19]

Chen

[11] Patent Number: 4,975,813

[45] Date of Patent: Dec. 4, 1990

[54] LAMP HOLDER

[76] Inventor: Shih-Tse Chen, No. 5, Lane 158, Sec. 1, An-Chung Rd., Tainan City, Taiwan

[21] Appl. No.: 362,482

[22] Filed: Jun. 7, 1989

[51] Int. Cl.[5] ..... H01R 33/00

[52] U.S. Cl. ..... 362/226; 362/394; 362/457; 439/253

[58] Field of Search ..... 362/226, 429, 394, 95, 362/430, 457, 458; 313/318; 439/245, 253, 256, 257

[56] References Cited

U.S. PATENT DOCUMENTS

| | | | |
|---|---|---|---|
| 1,585,109 | 5/1926 | Recker | 362/226 |
| 2,166,790 | 7/1939 | Benander | 362/226 |
| 2,913,714 | 11/1959 | Pantyke | 362/226 |

FOREIGN PATENT DOCUMENTS

| | | | |
|---|---|---|---|
| 172267 | 11/1921 | United Kingdom | 439/253 |

*Primary Examiner*—Ira S. Lazarus
*Assistant Examiner*—D. M. Cox
*Attorney, Agent, or Firm*—Willin Brinks Olds Hofer Gilson & Lione

[57] ABSTRACT

A lamp holder includes a housing with an upper and a lower compartment. The upper compartment contains a fixed clamp block and a movable clamp block which can be moved away from and towards the first clamp block by means of a spring biased push member. The clamp blocks confine a cavity for receiving and clamping the lamp seat of a lamp. The lamp can be easily mounted on the lamp holder by simply pushing and releasing the push member.

10 Claims, 5 Drawing Sheets

LAMP HOLDER

BACKGROUND OF THE INVENTION

This invention relates to a lamp holder, and particularly to a lamp holder which has a housing confining an upper compartment for receiving a lamp seat of a lamp and a lower compartment accommodating a switch.

A typical lamp holder of the type described above is shown in FIG. 1, wherein a substantially cylindrical housing includes a partition plate 11 dividing the housing into two chambers. The upper one of the chambers is provided with a cylindrical conductive plate 12 to receive and engage with a threaded conductive lamp seat 21. An angled conductive plate 13 is mounted on the partition plate 11 with one end thereof in contact with a contact 22 of the lamp. Another contact plate 15 is mounted on a support member of the housing so as to be electrically connected with or disconnected from the angled conductive plate through a turnable conductive plate 141 which is operated by an operating rod 14. Such a lamp holder requires a larger amount of conductive material such as copper to fabricate the cylindrical conductive plate which must serve as both a conductor and a screw coupling member. In addition, when using this lamp holder, the lamp seat of the lamp must be screwed lightly in the cylindrical conductive plate 12 so as to be held firmly thereby. The screw coupling operation of the lamp holder and the lamp seat is time-consuming. It is especially inconvenient when a plurality of lamps are required to be temporarily installed in a place such as a theater or the like necessitating that the lamps be attached to the lamp seat before use and detached therefrom after use. Moreover, when using the above-described lamp holder, the lamp is frequently damaged due to excessive pressure applied thereon during the attaching or detaching operation.

SUMMARY OF THE INVENTION

An object of the invention is to provide a lamp holder of the type described above with an improvement which enables the lamp seat of a lamp to be held firmly by simple clamping operation.

Another object of the invention is to provide an improved lamp holder in which the conductor to be in contact with the lamp seat can be in the form of strip rather than in the form of a threaded cylinder, thereby reducing the amount of the conductive material used.

The present invention provides a lamp holder which includes a housing having a partition plate dividing the housing into an upper and a lower compartment, a first clamp member fixed in the housing and having a first recessed surface with an arc-shaped cross-section, a second clamp member provided movably in the housing and having a second recessed surface with an arc-shaped cross-section, the first and second recessed surfaces cooperating to confine a cavity for receiving and clamping the lamp seat, the second clamp member being movable between a clamping position and a releasing position relative to the first clamp member, means for moving the second clamp member away from and towards the first clamp member, the means being connected to the second clamp member and operable from the outside of the housing by a linear movement operation, conductor means incorporated into the first and second clamp blocks for electrical connection between the lamp seat and the clamp blocks, and switch means provided in the lower compartment of the housing, including an operating rod which extends outward from the housing.

The moving means may include a push plate provided outside the housing adjacent to the first clamp block, the push plate having a sliding rod extending therefrom, the rod being slideably passing through the first clamp block and connected to the second clamp block, and a spring means which urges the push plate to an outwardly projecting position. The sliding rod includes elongated sleeve members formed integrally with the push plate, as well as bolt members inserted into the sleeve members.

The conductor means may include two curved threaded plates which respectively abut with the first and second clamp blocks in the first and second recesses and are secured thereto respectively. Alternatively, the conductor means includes conductive strips attached to said first or second clamp blocks.

The present exemplary preferred embodiment will be described in detail with reference to the accompanying drawings, in which:

DETAILED DESCRIPTION OF THE PREFERRED EMBODIMENTS

Figure 2:
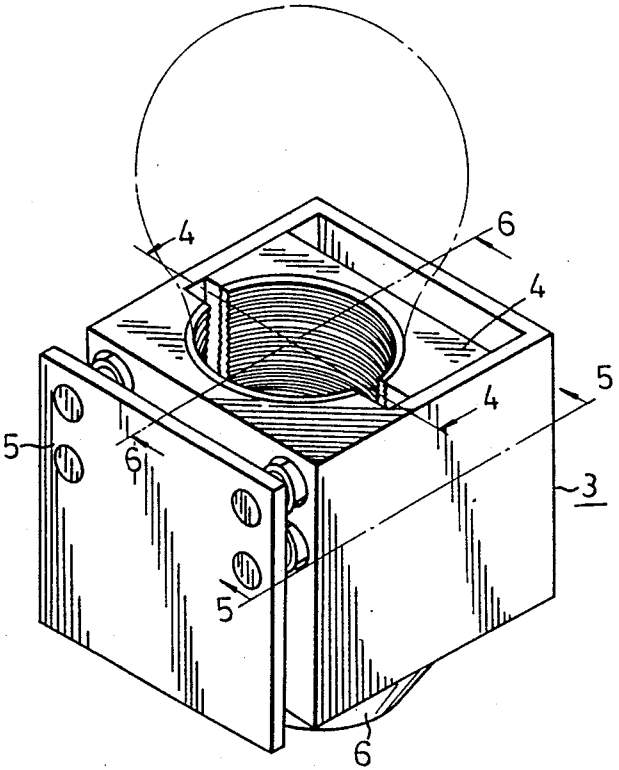
FIG. 2 is a perspective view of a lamp holder according to the present invention.
Figure 1:
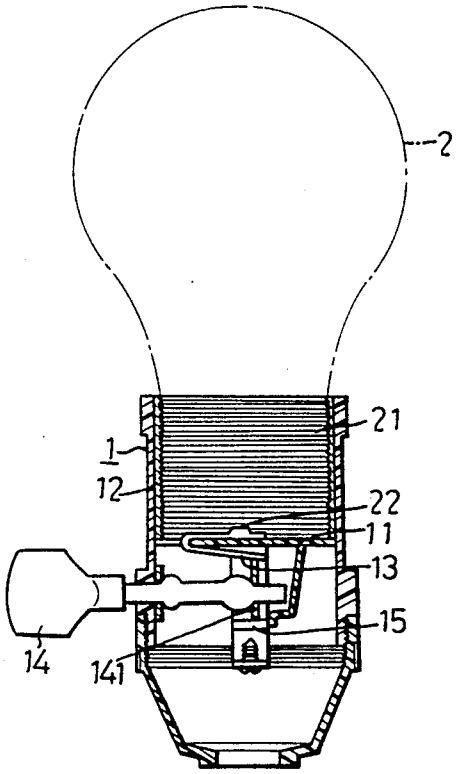
FIG. 1 (PRIOR ART)
FIG. 1 is a sectional view of a conventional lamp holder.
Figure 3:
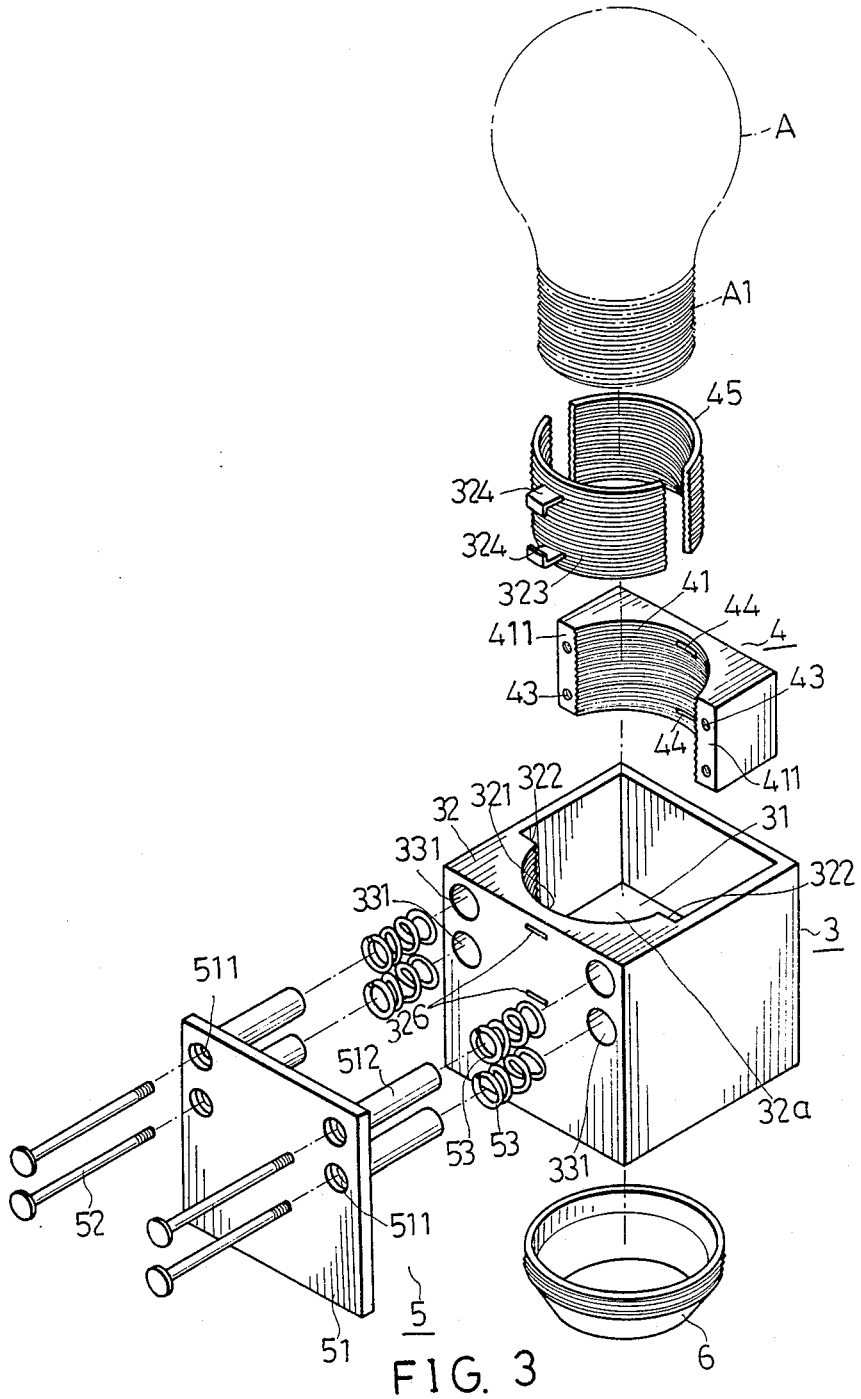
FIG. 3 is an exploded view of the lamp holder of FIG. 2.

Referring to FIGS. 1 through 7, a lamp A with a lamp seat A1 and a lamp holder therefor according to the present invention are shown, wherein the lamp holder includes a housing 3, a clamp block 4, a moving means 5 and a cap 6.

The housing 3 is made of a heat-resistant insulating material and has a hollow rectangular crosssection. A transverse partition plate 31 is provided in the housing 3 to divide the housing 3 into an upper and a lower compartment. A four-sided clamp block 32 is formed integrally with the housing 3 in the upper compartment and has a recess **32*a* having a segmental cross-section and two end faces 322. The inner side 321 of the block 32 which defines the recess 32*a* is provided with screw threads so as to engage with a curved threaded conductive plate 323 which is attached thereto. The conductive plate 323 has two hook members 324 which engage with slots 326 of the clamp block 32**.

The clamp block 32 is further provided with four through-holes 33 whose axes are perpendicular to the axis of the recess **32*a* and each of which has an enlarged portion 331 located near the outer side of the clamp block 32**.

Figure 4:
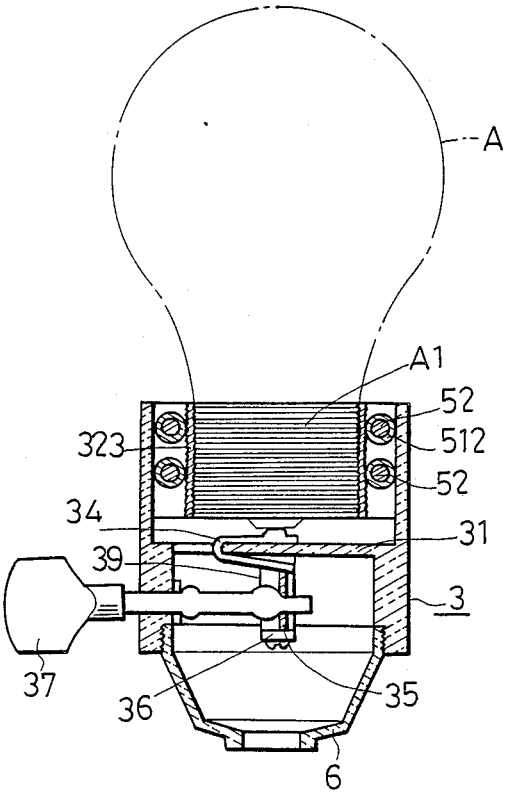
FIG. 4 is a sectional view of the lamp holder taken along line 4—4 of FIG. 2.
Figure 7:
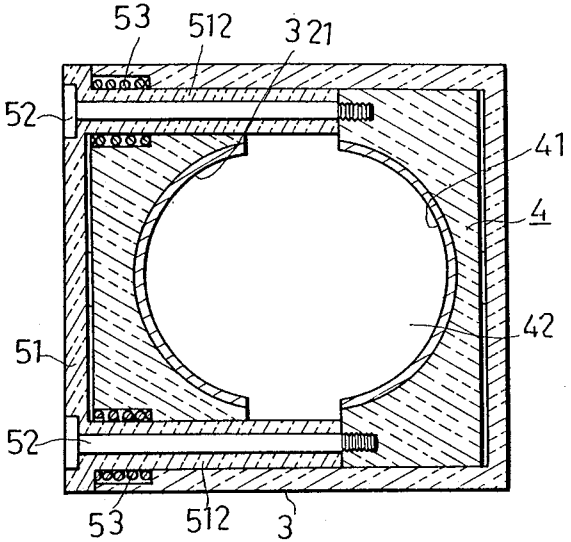
FIG. 7 is a sectional view of the lamp holder taken along line 5—5 of FIG. 2 in a releasing position.
Figure 6:
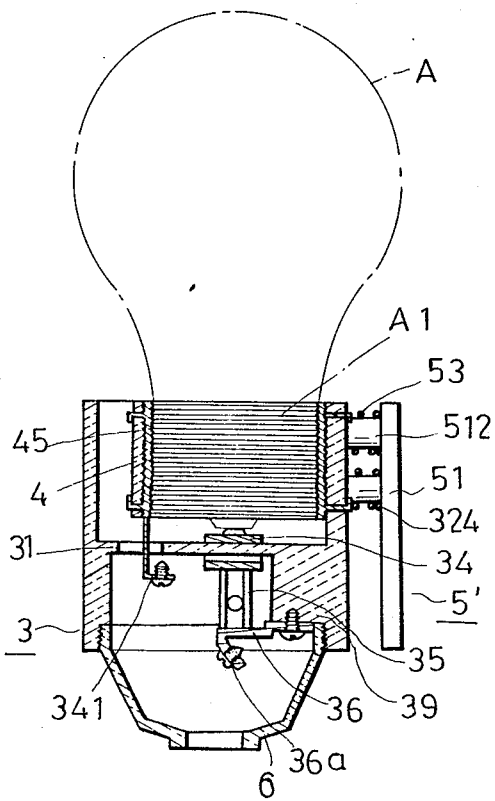
FIG. 6 is a sectional view of the lamp holder taken along line 6—6 of FIG. 2.

As shown in FIGS. 4 and 6, on the partition plate 31 is mounted a substantially V-shaped conductive plate 34 which has an upper portion in contact with a contact of the lamp A and a lower portion passing through an opening of the partition plate and extending below the partition plate 31. Another contact plate 36 is secured to a bottom edge of a support plate which extends inward from the inner side of the housing and which extends downward from the partition plate 31. The contact plate 36 is provided with a terminal 36*a* to be connected to a conductor. An operating rod member 37 is attached rotatably to the wall of the housing 3 and extends into between the two contact plates 34, 36. The operating rod member 37 carries a longitudinal contact plate member 35 which can be turned to a first position in which the ends of the contact plate member 35 touch the contact plates 34 and 36 and a second position in which the ends thereof move away from the contact plates 34, 36. There is also a conductor 341 which extends downward through an opening of the partition plate 31 from the conductive plate 45 to be used for electrical connection with an outside conductor.

A movable clamp block 4 is provided in the housing above the partition plate 31 opposite to the clamp block 32 and is made of a heat resisting insulating material. A recess 42 which also has a segmental cross-section is provided in the clamp block 4. The movable clamp block 4 can be moved away from and towards the clamp block 32 and is provided with end faces 411 opposite to the end faces 322 of the block 32. The inner face 41 of the movable block 4 is threaded and a threaded curved conductive plate 45 is secured thereto by the engagement of two hook members (not shown) and two slots 44 in the block 4. The clamp block 4 is further provided with blind threaded holes 43 which open at the end faces 411 and which are aligned with the through-holes 33 of the clamp block 32.

Figure 5:
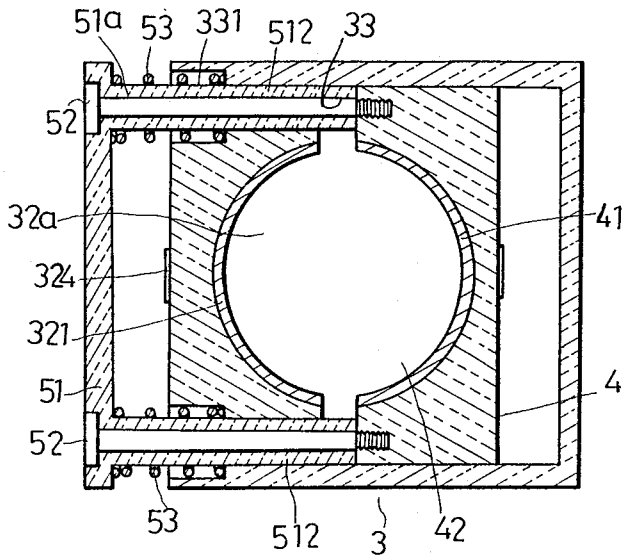
FIG. 5 is a sectional view of the lamp holder taken along line 5—5 of FIG. 2 in a normal clamping position.

The moving means 5 includes a push plate 51 integrally formed with four elongated sleeve members 512 which are communicated with openings 511 of the plate 51. The sleeve members 512 are inserted slideably in the through-holes 33. Four bolts 52 are fitted in the sleeve members 512 and screwed in the threaded holes 43 of the movable clamp block 4. Normally, the push plate 51 is biased to be spaced apart from the outer face of the clamp block 32, as shown in FIG. 5, by four compression springs 53. The compression springs 53 are respectively sleeved around the sleeve members 512 and are located in the enlarged portions 331 of the through-holes 33. Due to the biasing action of the spring 53, the clamp block 4 is kept in a clamping position with respect to the clamp block 3 so that the lamp seat Al can be clamped firmly between the two clamp blocks 32, 4. The cap 6 is attached to the open bottom of the housing 3, thereby closing the bottom of the housing 3.

It can be appreciated that the lamp A can be inserted easily between the clamp blocks 32 and 4 by pushing the push plate 51 towards the wall of the housing 3 to move the clamp block 4 away from the clamp block 32 and can be clamped firmly by releasing the push plate. Although curved conductive plates 323 and 45 are attached to the clamp blocks 32 and 4 to contact the entire peripheral surface of the lamp seat of the lamp A, the invention is not limited thereto. A conductor which can be in contact with a point or a part of the peripheral conductive surface of the lamp seat may be attached to the clamp block 32 or 4 for electrical connection between the lamp seat and the clamp blocks.

Figure 8:
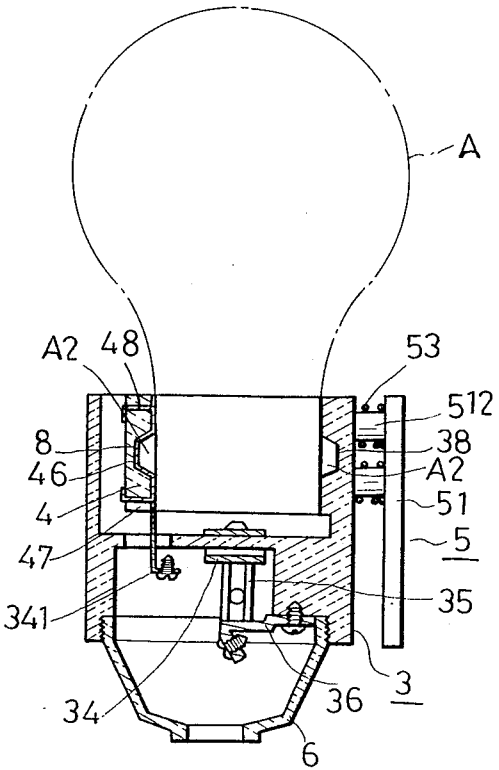
FIG. 8 is a sectional view of a lamp holder of another embodiment.

Another embodiment of the present invention is shown in FIG. 8 in which like elements are represented by like numerals. This embodiment differs from the previous embodiment in that the inner side 321 of the clamp block 32 is provided with a recess 38 which tapers inward. The inner side of the clamp block 4 is provided with a tapered recess 46, a bottom notch 47 and an upper slot 48. A bent conductive plate 8 is attached firmly to the clamp block 4 by engaging in the slot 48, the recess 46 and the notch 47. The lamp to be held by the lamp holder of this type must have two projections A2 to engage with the recesses 38 and 46.

With the invention thus explained, it is apparent that various modifications and variations can be made without departing from the scope of the invention. It is therefore intended that the invention be limited only as indicated in the appended claims.

I claim:

1. A lamp holder for a lamp having a conductive lamp seat comprising:

a housing having an open top, an open bottom and a partition plate dividing said housing into an upper and a lower compartment;

a first clamp member fixed in said housing;

a second clamp member provided movably in said housing, said second clamp member being movable between a clamping position and a releasing position relative to said first clamp member;

said first and second clamp members being block members each of which has a recessed clamping face with an arc-shaped cross-section, said block member of said first clamp member being integrally formed with said housing;

means for moving said second clamp member away from and towards said first clamp member, said means being connected to said second clamp member and operable from the outside of said housing by a linear movement operation;

switch means provided in said lower compartment of said housing and having an electrical contact member to be in electrical connection with the conductive seat of the lamp; and conductor means incorporated into at least one of said first and second lamp members for electrical connection with the lamp seat.

2. A lamp holder as claimed in claim 1, wherein said switch means includes an operating rod which extends outward from said housing.

3. A lamp holder as claimed in claim 1, wherein said moving means includes a push plate provided outside said housing adjacent to said first clamp member, said push plate having a sliding rod means extending therefrom, said rod means being slideably passing through said first clamp member and connected to said second clamp member, and a spring means which urges said push plate to an outwardly projecting position.

4. A lamp holder as claimed in claim 3, wherein said sliding rod means includes elongated sleeve members formed integrally with said push plate and bolt members inserted into said sleeve members.

5. A lamp holder as claimed in claim 1, wherein said conductor means includes two curved and threaded plates which respectively abut with said first and second clamp member in said first and second recesses and are secured thereto respectively.

6. A lamp holder as claimed in claim 1, wherein said first and second clamp members are provided respectively with indentations in said first and second recessed surfaces, said conductor means includes a bent conductive strip axially extending in one of said first and second clamp members and engaging in one of said indentations.

7. A lamp holder for a lamp having a conductive lamp seat comprising:

a housing having an open top, an open bottom and a partition plate dividing said housing into an upper and a lower compartment;

a first clamp member fixed to said housing and having a first recessed clamping face having an arc-shaped cross-section;

a second clamp member provided movably in said upper compartment and having a second recessed clamping face opposite to said first recessed clamping face, said second clamp member being movable between a clamping position and a releasing position relative to said first clamp member;

means for moving said second clamp member, including a push plate provided outside said housing adjacent to said first clamp member, a sliding rod means extending from said push plate, passing through said first clamp member and then being connected to said second clamp member, and a spring means which urges said push plate to an outwardly projecting position;

a conductor means attached to at least one of said first and second clamping member so as to contact with the lamp seat of the lamp; and a switch means provided in said lower compartment of said housing, and connected electrically to said lamp seat.

8. A lamp holder as claimed in claim 7, wherein said conductor means includes first and second curved and threaded plates attached to said first and second recessed clamping faces respectively.

9. A lamp holder as claimed in claim 7, wherein said conductor means includes a conductive strip which is attached to one of said first and second recessed clamping faces and extends axially into said lower compartment.

10. A lamp holder as claimed in claim 7, wherein said switch means includes two fixed contact member which are spaced from one another in said lower compartment, and a movable contact member provided between said fixed contact members, and an operating member connected to said movable contact member and extending outward from said housing.

* * * * *

UNITED STATES PATENT AND TRADEMARK OFFICE

CERTIFICATE OF CORRECTION

PATENT NO. : 4,975,813

DATED : December 4, 1990

INVENTOR(S) : Shih-Tse Chen

It is certified that error appears in the above-identified patent and that said Letters Patent is hereby corrected as shown below:

In column 1, line 27, please delete "lightly" and substitute therefor --tightly--.

Column 6,

In Claim 10, line 2, please delete "member" and substitute therefor --members--.

Signed and Sealed this

Thirtieth Day of March, 1993

*Attest:*

STEPHEN G. KUNIN

*Attesting Officer*

*Acting Commissioner of Patents and Trademarks*